US009368851B2

(12) United States Patent
Shayegani et al.

(10) Patent No.: US 9,368,851 B2
(45) Date of Patent: Jun. 14, 2016

(54) WAVEGUIDE T-SWITCH

(71) Applicant: Space Systems/Loral, LLC, Palo Alto, CA (US)

(72) Inventors: Ali Shayegani, Los Altos, CA (US); Will Caven, San Jose, CA (US); Richard Hoffmeister, San Carlos, CA (US); Gerald Murdock, Sunnyvale, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 617 days.

(21) Appl. No.: 13/728,745

(22) Filed: Dec. 27, 2012

(65) Prior Publication Data

US 2014/0184353 A1 Jul. 3, 2014

(51) Int. Cl.
*H01P 1/12* (2006.01)

(52) U.S. Cl.
CPC ..... *H01P 1/122* (2013.01)

(58) Field of Classification Search
CPC ..... H01P 1/12; H01P 1/122
USPC ..... 333/106, 108, 254, 256, 258, 259
See application file for complete search history.

(56) References Cited

U.S. PATENT DOCUMENTS

| | | | | |
|---|---|---|---|---|
| 4,201,963 | A | 5/1980 | Welti | |
| 4,242,652 | A | 12/1980 | Shishido et al. | |
| 4,761,622 | A | 8/1988 | Cracknell et al. | |
| 4,945,320 | A | 7/1990 | Hettlage et al. | |
| 5,053,732 | A * | 10/1991 | Elgass | H01P 1/122 333/106 |
| 5,155,456 | A * | 10/1992 | Ruff | H01P 1/12 333/106 |
| 5,347,243 | A * | 9/1994 | Kich | H01P 1/122 333/106 |
| 6,201,906 | B1 | 3/2001 | Kich et al. | |
| 6,489,858 | B2 | 12/2002 | Barker et al. | |
| 6,951,941 | B2 | 10/2005 | Kwiatkowski | |
| 2004/0183615 | A1 | 9/2004 | Dybdal | |

* cited by examiner

*Primary Examiner* — Benny Lee
*Assistant Examiner* — Jorge Salazar, Jr.
(74) *Attorney, Agent, or Firm* — Weaver Austin Villeneuve & Sampson LLP

(57) ABSTRACT

An arrangement is disclosed for providing the functionality of a four port, four channel rotary switch. The arrangement includes a first four port rotary microwave switch, the first switch including a first rotor and a first set of four waveguide ports, and a second four port rotary microwave switch, communicatively coupled to the first switch, the second switch including a second rotor and a second set of four waveguide ports. Each of the first switch and the second switch has at most three channels.

13 Claims, 6 Drawing Sheets

Section b-b

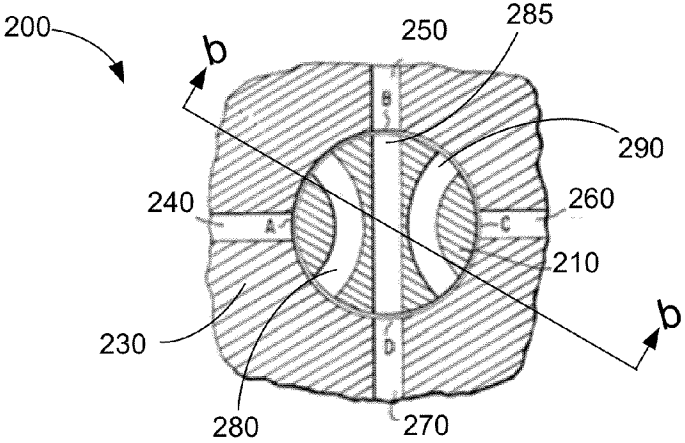
FIG. 2A
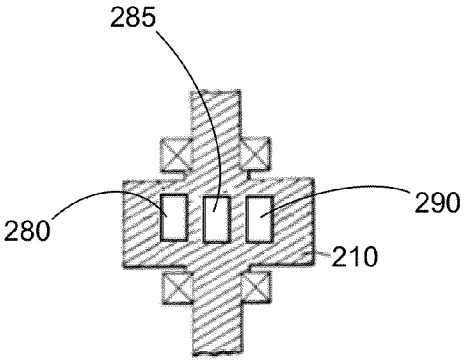
Section b-b
FIG. 2B
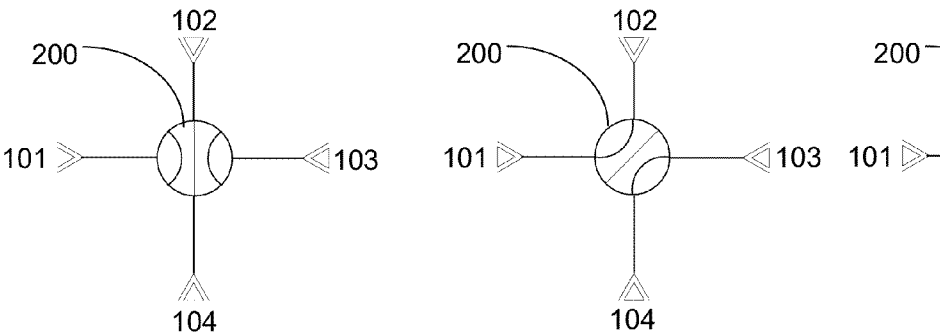
FIG. 2C
FIG. 2D
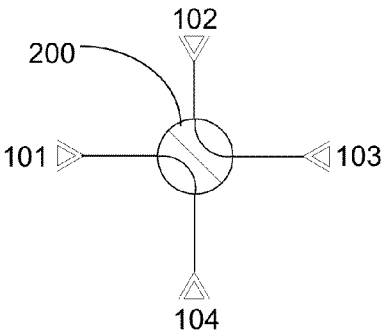
FIG. 2E
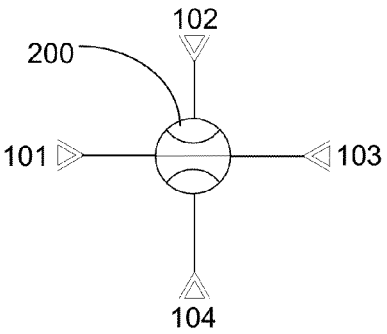
FIG. 2F
PRIOR ART

WAVEGUIDE T-SWITCH

TECHNICAL FIELD

This invention relates generally to a waveguide T-Switch, and more particularly to obtaining T-switch functionality with an arrangement of interconnected C-switches.

BACKGROUND

The assignee of the present invention manufactures and deploys spacecraft for, inter alia, communications and broadcast services from geosynchronous orbit. Payload systems for such spacecraft may include high power microwave radio frequency (RF) components such as travelling wave tube amplifiers (TWTA's) interconnected with waveguides. The payload may include a number of channels or paths in order to provide system redundancy or other functionalities that require switching. A substantial number of waveguide switches are necessary to enable redundant components to be switched in for components that have failed and to facilitate switching between alternate channels.

Flight qualified waveguide switches with extensive flight heritage include, four port, two channel switches ("C" switches, or C-switches) as illustrated in FIG. 1A through FIG. 1D, and, four port, three channel switches ("R" switches, or R-switches) as illustrated in FIG. 2A through FIG. 2F. Cracknell, U.S. Pat. No. 4,761,622, for example describes a C-switch (referred to therein as an "S" switch) and an R-switch of a known configuration.

A better understanding of a typical mechanical design of a C-switch may be obtained by referring to FIG. 1A which is a transverse section through stator 130 and rotor 110 of switch 100, and FIG. 1B, which is a longitudinal section view along line "b-b" through rotor 110 and bearings 120. Switch 100 includes rotor 110, which may generally be cylindrical in form, and which is arranged to rotate on bearings 120 in stator 130. Four waveguide channels 140, 150, 160, and 170 are located within stator 130 and provide passages along which microwave energy may be conveyed. Each of the waveguide channels 140, 150, 160, and 170 have an interior termination at a respective internal port A, B, C and D, adjacent to the rotor 110. Each of the waveguide channels 140, 150, 160 and 170 may be communicatively coupled via an exterior termination to respective external ports 101, 102, 103 and 104, illustrated in FIG. 1C. Ports A, B, C, and D may lie in a common plane and be arranged at 90 degree intervals around rotor 110. Rotor 110 includes two curved passages 180 and 190 located which are arranged such that their openings at the rotor circumference are spaced at 90 degree intervals. In the orientation shown in FIG. 1A, internal ports A and B are interconnected, as are internal ports C and D. Correspondingly, external ports 101 and 102 are interconnected, as are external ports 103 and 104. It will be appreciated, however, that if rotor 110 is rotated through 90 degrees in a clockwise or counter clockwise direction, the configuration of FIG. 1D will result, wherein external ports 101 and 104 are interconnected, as are external ports 102 and 103. Thus, as a result, energy transmitted into port 101 may be switched into either one of port 102 or port 104, depending on the orientation of rotor 110.

It will be appreciated that an identical connection arrangement results from rotating rotor 110 through 180 degrees in either the clockwise or counter clockwise direction. Thus, a C-switch is said to have 2 possible positions notwithstanding that rotor 110 may assume any one of 4 valid mechanical angular positions.

A better understanding of typical mechanical design of an R-switch may be obtained by referring to FIG. 2A, which is a transverse section through stator 230 and rotor 210 of switch 200, and FIG. 2B, which is a longitudinal section through rotor 210. An R-switch may be similar to the C-switch described above inasmuch as it includes two curved passages 280 and 290 within rotor 210. In addition, rotor 210 includes a further passage 285, which is straight and is arranged between curved passages 280 and 290, along a diameter of rotor 210.

The illustrated R-switch configuration permits a larger variety of interconnections to be made between four waveguide channels 240, 250, 260 and 270 located within stator 230, and having internal ports A, B, C and D respectively, than is possible with the C-switch illustrated in FIG. 1A through 1D. In the position illustrated in FIG. 2A, which corresponds to the configuration illustrated schematically in FIG. 2C, ports B and D only are interconnected. If, however, rotor 210 is rotated through 45 degrees clockwise from the position shown, then internal ports A and B are interconnected, and internal ports C and D are interconnected, by the curved passages 280 and 290 respectively, resulting in the configuration illustrated schematically in FIG. 2D. Similarly, if rotor 210 is rotated through 45 degrees counter clockwise from the position illustrated in FIG. 2A, then internal ports B and C are interconnected, and internal ports A and D are interconnected, resulting in the configuration illustrated schematically in FIG. 2E. Finally, if rotor 210 is rotated through 90 degrees, either clockwise or counter clockwise, from the position illustrated in FIG. 2A, then only ports A and C are interconnected, resulting in the configuration illustrated schematically in FIG. 2F.

Although C-switches and R-switches as described above are highly reliable and commonly used for space applications, they do not provide the flexibility required for some applications. For example, it may be observed that neither a C-switch nor an R-switch permits simultaneous connection of ports 101 with 103, and ports 102 with 104. This limitation can be avoided by a four port, four channel switch ("T switch" or T-switch), as illustrated schematically in FIG. 3A through FIG. 3C.

Satisfactory hardware solutions for the T-switch configuration illustrated schematically in FIG. 3A through FIG. 3C have eluded the industry, at least for applications demanding a waveguide interface suitable for high RF power applications. Proposed solutions described in U.S. Pat. Nos. 4,201,963, 6,201,906, and 6,489,858, for example, have not been adapted for space use because the solutions are mechanically complex, and pose reliability issues.

Thus, an improved approach to providing T-switch functionality is desired that avoids these shortcomings.

SUMMARY OF INVENTION

The present inventors have appreciated that a T-switch functionality can be provided, by an arrangement that includes two existing-design C-switches or R-switches coupled together in the manner described herein below.

In an embodiment, the arrangement includes a first four port rotary microwave switch, the first switch including a first rotor and a first set of four waveguide ports, and a second four port rotary microwave switch, communicatively coupled to the first switch, the second switch including a second rotor and a second set of four waveguide ports, wherein each switch has at most three channels, and the arrangement provides a switching functionality of a T-switch.

In another embodiment, a first waveguide port of the first set of four waveguide ports may be communicatively coupled to a first waveguide port of the second set of four waveguide ports, and a second waveguide port of the first set may be communicatively coupled to a second waveguide port of the second set.

In further embodiment, the arrangement may be configured to switchably interconnect a third waveguide port of the first set of four waveguide ports to a selected one of: (i) a fourth waveguide port of the first set; (ii) a third waveguide port of the second set of four waveguide ports; and (iii) a fourth waveguide port of the second set. The arrangement may also be configured to switchably interconnect the fourth waveguide port of the first set of four waveguide ports to a selected one of: (i) the third waveguide port of the first set of four waveguide ports; (ii) the third waveguide port of the second set of four waveguide ports; and (iii) the fourth waveguide port of the second set. The arrangement may also be configured to switchably interconnect the third waveguide port of the second set of four waveguide ports to a selected one of: (i) the third waveguide port of the first set of four waveguide ports; (ii) the fourth waveguide port of the first set; and (iii) the fourth waveguide port of the second set of four waveguide ports. The arrangement may also be configured to switchably interconnect the fourth waveguide port of the second set of four waveguide ports to a selected one of: (i) the third waveguide port of the first set of four waveguide ports; (ii) the fourth waveguide port of the first set; and (iii) the third waveguide port of the second set of four waveguide ports.

In an embodiment, at least one of the first switch and the second switch may be a two channel switch or a three channel switch. The two channel switch may be a C-switch. The three channel switch may be an R-switch.

In another embodiment, the first set of four waveguide ports may include a first port, a second port, a third port, and a fourth port, a first angular position of the first rotor providing a first coupling between the first port and the second port and a second coupling between the third port and the fourth port; a second angular position of the rotor providing a third coupling between the first port and the third port and a fourth coupling between the second port and the fourth port. The second set of four ports may include a fifth port, a sixth port, a seventh port, and an eighth port, a third angular position of the second rotor providing a fifth coupling between the fifth port and the eighth port and a sixth coupling between the sixth port and the seventh port, a fourth angular position of the second rotor providing a seventh coupling between the fifth port and the seventh port, and an eighth coupling between the sixth port and the eighth por. The first port may be communicatively coupled with the fifth port, and the second port may be communicatively coupled with the sixth port. When the first rotor is in the first angular position, the third port may be communicatively coupled with the fourth port and the seventh port may be communicatively coupled with the eighth port. When the first rotor is in the second angular position and the second rotor is in the fourth angular position, the third port may be communicatively coupled with the eighth port and the fourth port may be communicatively coupled with the seventh port. When the first rotor is in the second angular position and the second rotor is in the third angular position, the third port may be communicatively coupled with the seventh port and the fourth port may be communicatively coupled with the eighth port. The first port may be nonselectively coupled with the fifth port, and the second port is nonselectively coupled with the sixth port.

In another embodiment, the first set of four waveguide ports may include a first port, a second port, a third port, and a fourth port, a first angular position of the first rotor providing a first coupling between the first port and the third port and a second coupling between the second port and the fourth port; a second angular position of the rotor providing a third coupling between the first port and the second port and a fourth coupling between the third port and the fourth port. The second set of four ports may include a fifth port, a sixth port, a seventh port, and an eighth port, a third angular position of the second rotor providing a fifth coupling between the fifth port and the eighth port and a sixth coupling between the sixth port and the seventh port. A fourth angular position of the second rotor may provide a seventh coupling between the fifth port and the seventh port, and an eighth coupling between the sixth port and the eighth port. The first port may be communicatively coupled with the fifth port, and the second port is communicatively coupled with the sixth port. When the first rotor is in the first angular position and the second rotor is in the third angular position, the third port may be communicatively coupled with the eighth port and the fourth port is communicatively coupled with the seventh port. When the first rotor is in the second angular position, the third port is communicatively coupled with the fourth port and the seventh port is communicatively coupled with the eighth port. When the first rotor is in the first angular position and the second rotor is in the fourth angular position, the third port may be communicatively coupled with the seventh port and the fourth port may be communicatively coupled with the eighth port. The first port may be nonselectively coupled with the fifth port, and the second port may be nonselectively coupled with the sixth port.

In a further embodiment, the arrangement may include a common housing and/or a common stator for the first switch and/or the second switch In an embodiment, the first switch and the second switch may be approximately coplanar.

In another embodiment, the first switch and the second switch may be stacked.

BRIEF DESCRIPTION OF THE DRAWINGS

The included drawings are for illustrative purposes and serve only to provide examples of possible structures for the disclosed inventive switching arrangement. These drawings in no way limit any changes in form and detail that may be made by one skilled in the art without departing from the spirit and scope of the disclosed embodiments.

FIG. 2A through FIG. 2F shows examples of a four port, three channel rotary switch ("R-switch") according to the prior art.

.

Figure 1A:
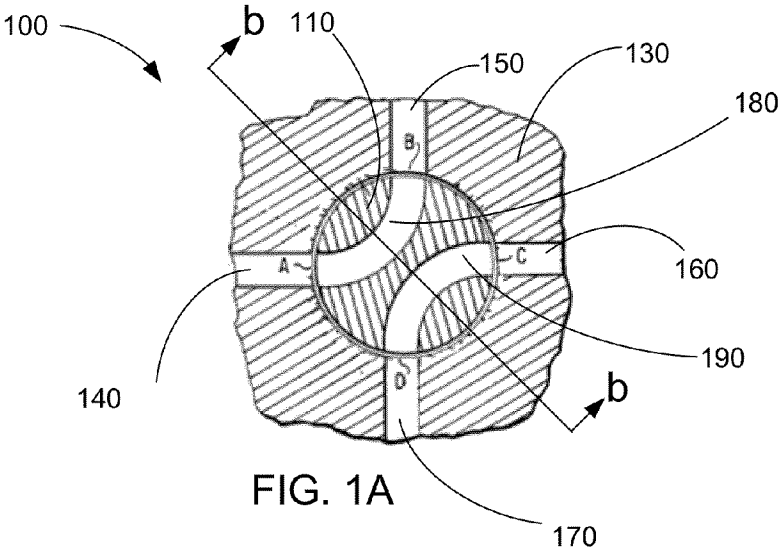
FIG. 1A through FIG. 1D shows examples of a four port, two channel rotary switch ("C-switch") according to the prior art.
Figure 1B:
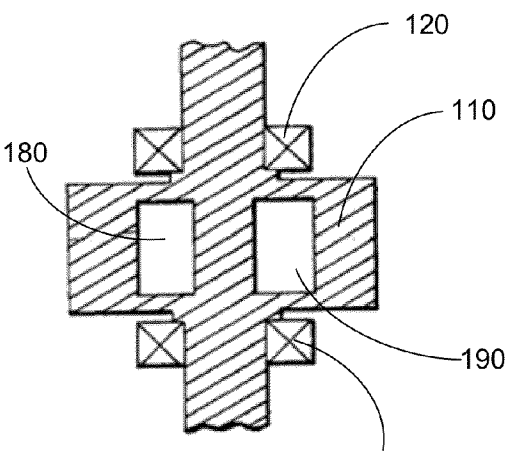
Figure 1C:
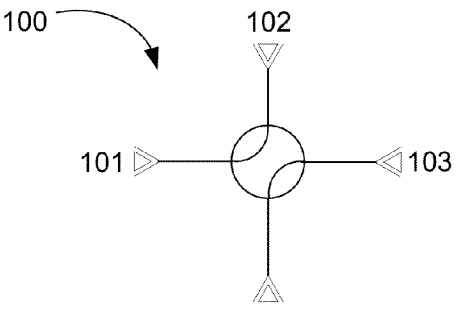
Figure 1D:
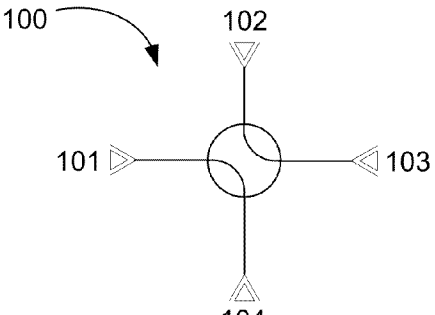
FIG. 1D PRIOR ART
Figure 3A:
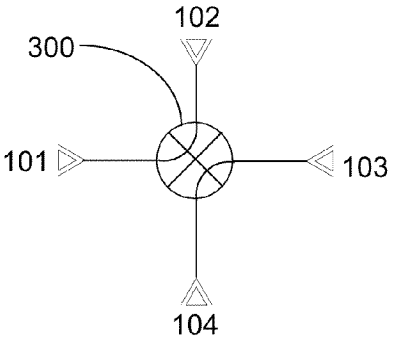
FIG. 3A through FIG. 3C is schematic illustration of a four port, four channel rotary switch.("T-switch").
Figure 3B:
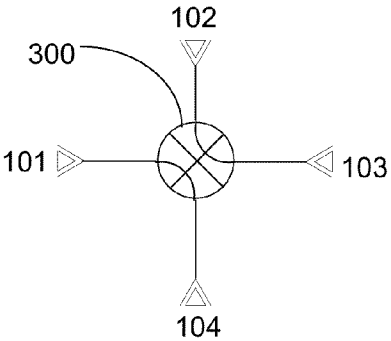
Figure 3C:
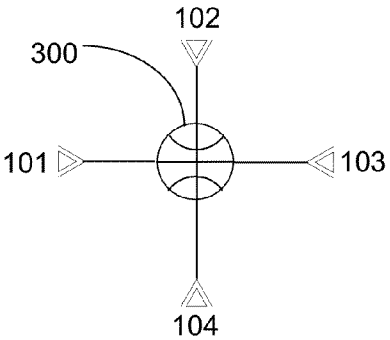

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the disclosed subject matter, as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. It will be understood that although the terms "first" and "second" are used herein to describe various elements, these elements should not be limited by these terms. These terms are used only to distinguish one element from another element. As used herein, the term "and/or" includes any and all combinations of one or more of the associated listed items. The symbol "/" is also used as a shorthand notation for "and/or".

The terms "spacecraft", "satellite" may be used interchangeably herein, and generally refer to any orbiting satellite or spacecraft system.

The present inventors have appreciated that a T-switch functionality can be provided by an arrangement that includes two existing-design rotary switches communicatively coupled in the manner described hereinbelow.

Figure 4A:
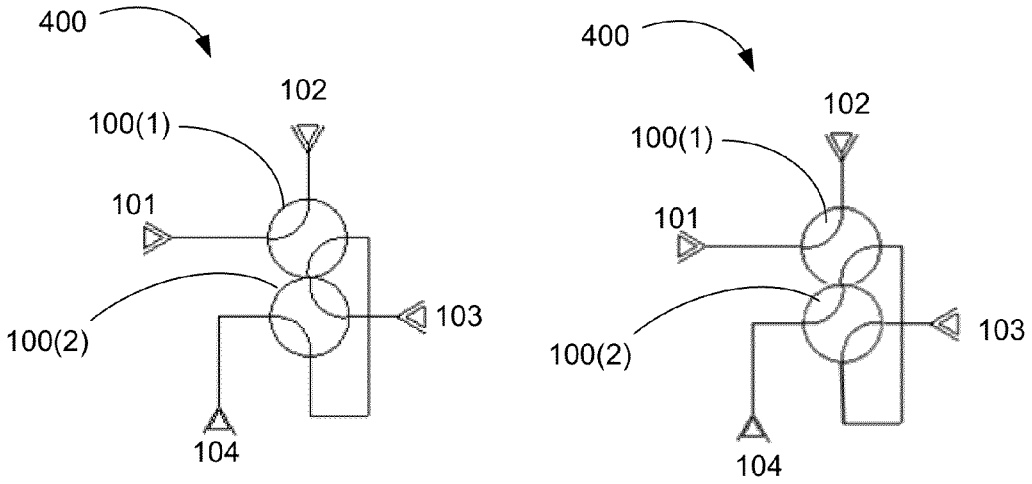
FIG. 4A through FIG. 4C shows an example of communicatively coupled C-switches according to an embodiment.
Figure 4B:
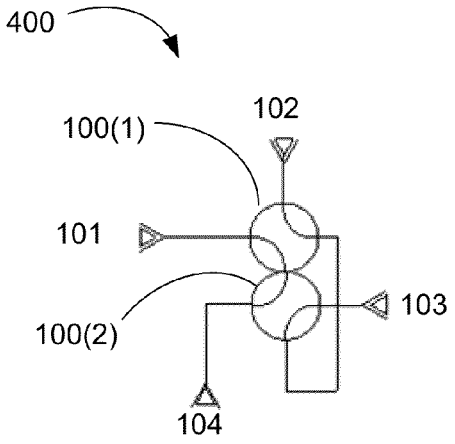
Figure 4C:
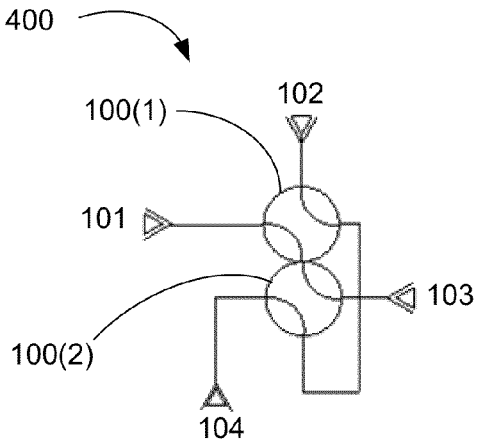

Referring to FIG. 4A through FIG. 4C, an example arrangement is illustrated that includes two rotary switches 100(1) and 100(2), each being a 2 channel, four port switch, that may be referred to as a C-switch, in a manner whereby the arrangement provides full T-switch functionality. Although each rotary switch 100(1) and 100(2) is illustrated in FIG. 4A through FIG. 4C as having a C-switch configuration, it will be appreciated that an arrangement wherein one or both of the rotary switches is a 3 channel, four port switch, (e.g., an R-Switch) may provide similar functionality.

The illustrated arrangement permits simultaneous connection of any two pairs of ports. For example, it may be observed that port 101 may be connected to any selected port. More particularly, port 101 is illustrated as interconnected with port 102 in FIG. 4A, with port 104 in FIG. 4B, and with port 103 in FIG. 4C. Moreover, simultaneous interconnection of any two pairs of ports is enabled. Referring to FIG. 4A, for example, interconnection of a first pair of waveguide ports, 101 and 102 is obtained, while a second pair of waveguide ports, 103 and 104 is also connected. Similarly, referring now to FIG. 4B, interconnection of a third pair of waveguide ports, 101 and 104 is obtained, while a fourth pair of waveguide ports, 102 and 103 is also connected. Finally, referring now to FIG. 4C, simultaneous interconnection of a fifth pair of waveguide ports, 101 and 103 is obtained, while a sixth pair of waveguide ports, 102 and 103 is also connected.

The examples illustrated in FIG. 4A, 4B, and 4C may suggest a close proximity between each pair 100(1) and 100(2) of rotary switches. However, the rotary switches may be separated by an arbitrary distance. For example, a first and second rotary switch of the proposed configuration may be coupled by waveguide such that any convenient distance or other geometric relationship between the first and second rotary switch may be obtained.

Figure 5A:
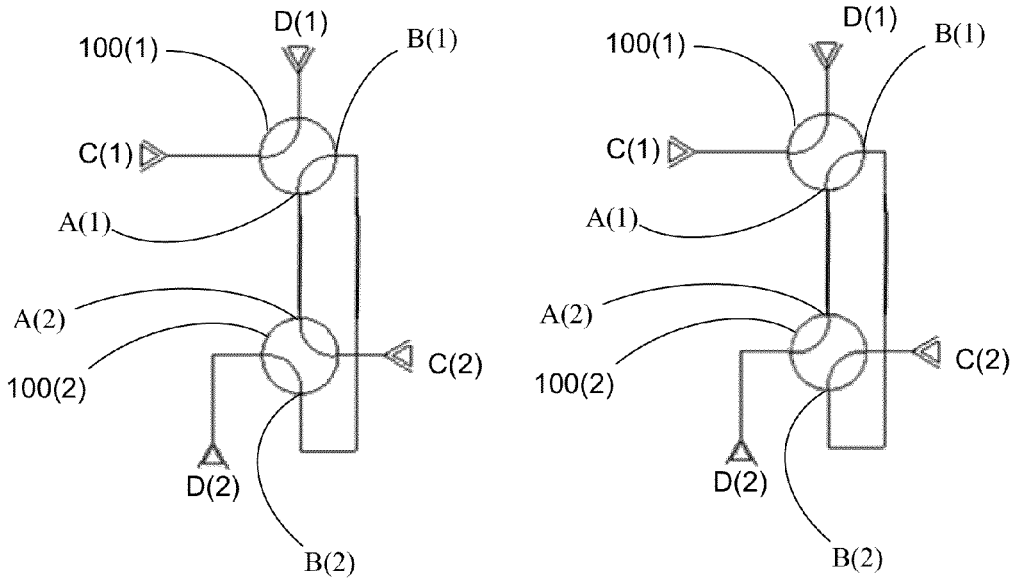
FIG. 5A through FIG. 5C shows an example of communicatively coupled C-switches according to another embodiment.

Referring now to FIG. 5A it is illustrated how a similar T-switch functionality may be obtained by a pair of physically separated rotary switches. Waveguide port A(1) of rotary switch 100(1) may be communicatively coupled, by a waveguide, for example, to waveguide port A(2) of rotary switch 100(2). For convenience, port A(1) may be referred to as the first waveguide port of the first set of four waveguide ports included in switch 100(1), or more simply as "first port A(1)". Similarly, port A(2) may be referred to as the first waveguide port of the second set of four waveguide ports included in switch 100(2), or simply as "fifth port A(2)". Waveguide port B(1) of rotary switch 100(1) may be communicatively coupled, by a waveguide, for example, to waveguide port B(2) of rotary switch 100(2). For convenience, port B(1) may be referred to as the second waveguide port of the first set of four waveguide ports included in switch 100(1), or as "second port B(1)". Similarly port B(2) may be referred to as the first waveguide port of the second set of four waveguide ports included in switch 100(2), or as "sixth port B(2)".

Rotary switches 100(1) and 100(2) may switchably interconnect port C(1), which may be referred to as the third waveguide port of the first set of four waveguide ports, or "third port C(1)" with a selected one of port D(1), port C(2), and port D(2). Port D(1), port C(2), and port D(2) may be referred to, respectively, as the fourth waveguide port of the first set of four waveguide ports, the third waveguide port of the second set of four waveguide ports, and the fourth waveguide port of the fourth set of four waveguide ports. More shortly, Port D(1), port C(2), and port D(2) may be referred to, respectively as "fourth port D(1). "seventh port C(2)", and "eighth port D(2)".

Referring still to FIG. 5A, it is shown that a respective position of each of switch 100(1) and switch 100(2) may be selectively set such that third port C(1) is interconnected with fourth port D(1). Moreover, referring now to FIG. 5B, it is shown that a respective position of each of switch 100(1) and switch 100(2) may be selectively set such that third port C(1) is interconnected with eighth port D(2). Finally, referring now to FIG. 5C, it is shown that a respective position of switch 100(1) and switch 100(2) may be selectively set such that third port C(1) is interconnected with seventh port C(2).

Rotary switches 100(1) and 100(2) may switchably interconnect fourth port D(1) with a selected one of third port C(1), seventh port C(2), and eighth port D(2). For example, referring again to FIG. 5A, it is shown that a respective position of switch 100(1) and switch 100(2) may be selectively set such that fourth port D(1) is interconnected with third port C(1). Moreover, referring now to FIG. 5B, it is shown that a respective position of switch 100(1) and switch 100(2) may be selectively set such that fourth port D(1) is interconnected with seventh port C(2). Finally, referring now to FIG. 5C, it is shown that a respective position of switch 100(1) and switch 100(2) may be selectively set such that fourth port D(1) is interconnected with eighth port D(2).

Similarly, rotary switches 100(1) and 100(2) may switchably interconnect seventh port C(2) with a selected one of third port C(1), fourth port D(1), and eighth port D(2). For example, referring again to FIG. 5A, it is shown that a respective position of switch 100(1) and switch 100(2) may be selectively set such that seventh port C(2) is interconnected with eighth port D(2). Moreover, referring now to FIG. 5B, it is shown that a respective position of switch 100(1) and switch 100(2) may be selectively set such that seventh port C(2) is interconnected with fourth port D(1). Finally, referring now to FIG. 5C, it is shown that a respective position of switch 100(1) and switch 100(2) may be selectively set such that seventh port C(2) is interconnected with third port C(1).

Finally, rotary switches 100(1) and 100(2) may switchably interconnect fourth port D(2), with a selected one of third port C(1), fourth port D(1), and seventh port C(2). For example, referring again to FIG. 5A, it is shown that a respective position of switch 100(1) and switch 100(2) may be selectively set such that eighth port D(2) is interconnected with seventh port C(2). Moreover, referring now to FIG. 5B, it is shown that a respective position of switch 100(1) and switch 100(2) may be selectively set such that eighth port D(2) is interconnected with third port C(1). Finally, referring now to FIG. 5C, it is shown that a respective position of switch 100(1) and switch 100(2) may be selectively set such that eighth port D(2) is interconnected with fourth port D(1).

It will be appreciated that the above described switching functionality may be achieved by appropriate selection of the respective angular position of a first rotor included in switch 100(1) and a second rotor included in switch 100(2) More particularly, in the example illustrated in FIG. 5A, a first angular position of the first rotor provides a first coupling between first port A(1) and second port B(1) and a second coupling between third port C(1) and fourth port D(1). A second angular position of the first rotor, illustrated in FIG. 5B and FIG. 5C, provides a third coupling between first port A(1) and third port C(1) and a fourth coupling between second port B(1) and fourth port D(1).

Figure 5B:
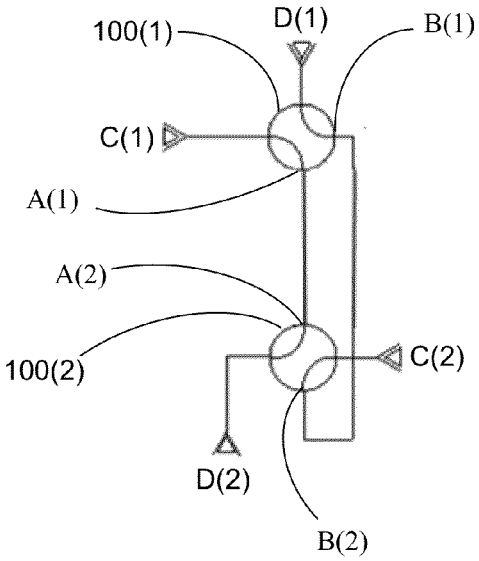
Figure 5C:
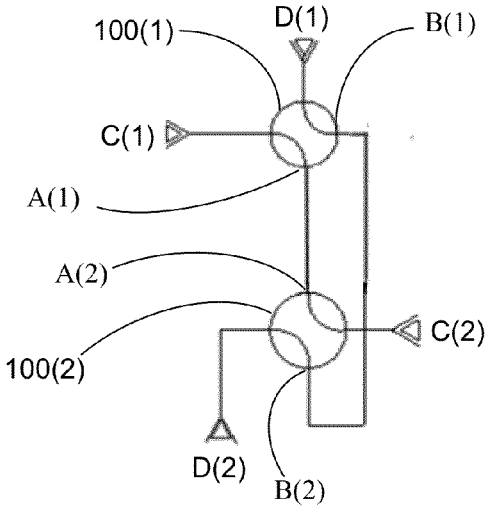

Moreover, an angular position of the second rotor, which may be referred to as the "third angular position", illustrated in FIG. 5A (left hand diagram) and FIG. 5C, provides a fifth coupling between fifth port A(2) and seventh port C(2) and a sixth coupling between sixth port B(2) and eighth port D(2). Another angular position of the second rotor (which may be referred to as the "fourth angular position"), illustrated in FIG. 5B, provides a seventh coupling between fifth port A(2) and eighth port D(2) and an eighth coupling between sixth port B(2) and seventh port C(2).

It will be observed that, in the embodiment illustrated in FIG. 5A, FIG. 5B, and FIG. 5C first port A(1) and fifth port A(2) are non-selectively coupled. For example, they may be interconnected by a length of unswitched waveguide that may include one or more straight and/or curved segments. Similarly, second port B(1) and sixth port B(2) are non-selectively coupled. As a result, referring now to FIG. 5A, when the first rotor is in the first angular position, and the second rotor is in either the third angular position (left hand diagram) or the fourth angular position (right hand diagram), third port C(1) is communicatively coupled with fourth port D(1) and seventh port C(2) is communicatively coupled with the eighth port D(2). More particularly, referring to the left hand diagram of FIG. 5A when the first rotor is in the first angular position, thereby coupling first port A(1) and second port B(1), and the second rotor is in the third angular position, thereby coupling fifth port A(2) with seventh port C(2) and sixth port B(2) with eighth port D(2), third port C(1) is communicatively coupled with fourth port D(1) and seventh port C(2) is communicatively coupled with the eighth port D(2).

Alternatively, referring to the right hand diagram of FIG. 5A, when the first rotor is in the first angular position, and the second rotor is in the fourth angular position, thereby coupling fifth port A(2) with eighth port D(2) and sixth port B(2) with seventh port C(2), third port C(1) is communicatively coupled with fourth port D(1) and seventh port C(2) is communicatively coupled with the eighth port D(2).

Moreover, referring now to FIG. 5B, when the first rotor is in the second angular position and the second rotor is in the fourth angular position, third port C(1) is communicatively coupled with eighth port D(2) and fourth port D(1) is communicatively coupled with seventh port C(2).

Finally, referring now to FIG. 5C, when the first rotor is in the second angular position and the second rotor is in the third angular position, third port C(1) is communicatively coupled with seventh port C(2) and fourth port D(1) is communicatively coupled with eighth port D(2).

Put shortly, as may be observed by comparing FIG. 3A and FIG. 5A, FIG. 3B and FIG. 5B, FIG. 3C and FIG. 5C, full functionality of a T-switch is obtained by the disclosed configuration of two interconnected C-switches.

In the embodiment illustrated in FIG. 5A through FIG. 5C, fifth port A(2) and sixth port B(2), which are non-selectively coupled, respectively, with first port A(1) and second port B(2), are nominally 180 degrees apart. That is, each of fifth port A(2) and sixth port B(2) may be considered to be respectively opposite to the other. On the other hand, first port A(1) and second port B(1), may be considered to be respectively adjacent, with first port A(1) disposed nominally 90 degrees clockwise with respect to second port B(1).

Figure 6A:
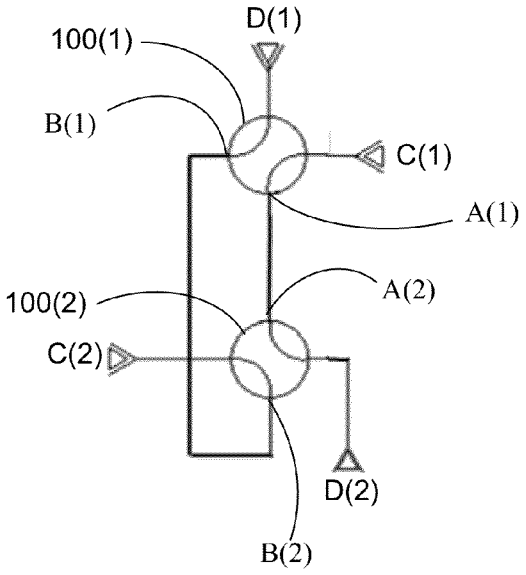
FIG. 6A through FIG. 6C shows an example of communicatively coupled C-switches according to another embodiment.
Figure 6C:
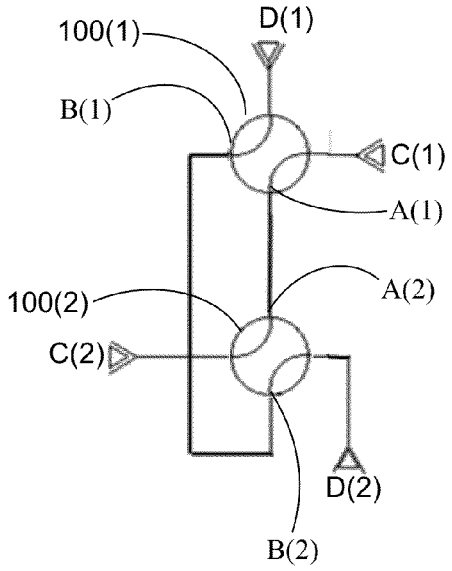
Figure 6B:
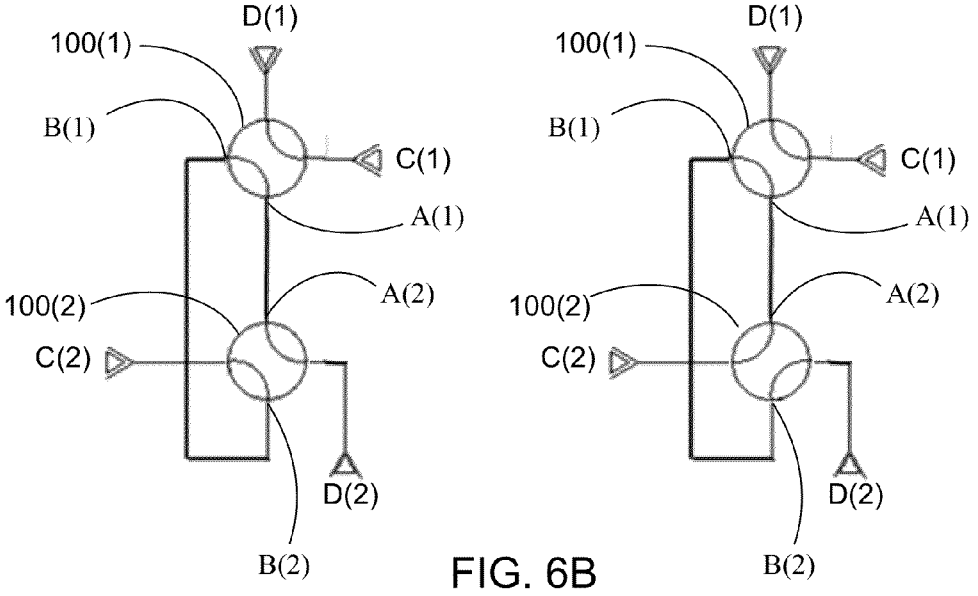

Other arrangements are within the contemplation of the present inventors. Referring now to FIG. 6A through FIG. 6C, for example, first port A(1) and second port B(1), which are non-selectively coupled, respectively, with fifth port A(2) and sixth port B(2), are configured such that first port A(1) is disposed nominally 90 degrees counterclockwise with respect to second port B(1). Full functionality of a T-switch may be obtained by the configuration illustrated in FIG. 6A through FIG. 6C, as elaborated hereinbelow.

Rotary switches 100(1) and 100(2) may switchably interconnect third port C(1) with a selected one of port D(1), port C(2), and port D(2). For example, referring now to FIG. 6A, it is shown that a respective position of switch 100(1) and switch 100(2) may be selectively set such that third port C(1) is interconnected with eighth port D(2). Moreover, referring now to FIG. 6B, it is shown that a respective position of switch 100(1) and switch 100(2) may be selectively set such that third port C(1) is interconnected with fourth port D(1). Finally, referring now to FIG. 6C, it is shown that a respective position of switch 100(1) and switch 100(2) may be selectively set such that third port C(1) is interconnected with seventh port C(2).

It will be appreciated that rotary switches 100(1) and 100(2) may switchably interconnect fourth port D(1) of switch 100(1), with a selected one of third port C(1), seventh port C(2), and eighth port D(2). For example, referring again to FIG. 6A it is shown that a respective position of switch 100(1) and switch 100(2) may be selectively set such that fourth port D(1) is interconnected with seventh port C(2). Moreover, referring now to FIG. 6B, it is shown that a respective position of switch 100(1) and switch 100(2) may be selectively set such that fourth port D(1) is interconnected with third port C(1). Finally, referring now to FIG. 6C, it is shown that a respective position of switch 100(1) and switch 100(2) may be selectively set such that fourth port D(1) is interconnected with eighth port D(2).

Similarly, rotary switches 100(1) and 100(2) may switchably interconnect seventh port C(2) of switch 100(2), with a selected one of third port C(1), fourth port D(1), and eighth port D(2). For example, referring again to FIG. 6A, it is shown that respective positions of switch 100(1) and switch 100(2) may be selectively set such that seventh port C(2) is interconnected with fourth port D(1). Moreover, referring now to FIG. 6B, it is shown that a respective position of switch 100(1) and switch 100(2) may be selectively set such that seventh port C(2) is interconnected with eighth port D(2). Finally, referring now to FIG. 6C, it is shown that a respective position of switch 100(1) and switch 100(2) may be selectively set such that seventh port C(2) is interconnected with third port C(1).

Finally, rotary switches 100(1) and 100(2) may switchably interconnect eighth port D(2) with a selected one of third port C(1), fourth port D(1), and seventh port C(2). For example, referring again to FIG. 6A, it is shown that a respective position of switch 100(1) and switch 100(2) may be selectively set such that eighth port D(2) is interconnected with third port C(1). Moreover, referring now to FIG. 6B, it is shown that a respective position of switch 100(1) and switch 100(2) may be selectively set such that eighth port D(2) is interconnected with seventh port C(2). Finally, referring now to FIG. 6C, it is shown that a respective position of switch 100(1) and switch 100(2) may be selectively set such that eighth port D(2) is interconnected with fourth port D(1).

In the example illustrated in FIG. 6A through FIG. 6C, a first angular position of the first rotor, illustrated in FIG. 6A and FIG. 6C, provides a first coupling between first port A(1) and third port C(1) and a second coupling between second port B(1) and fourth port D(1). A second angular position of the first rotor, illustrated in FIG. 6B, provides a third coupling between first port A(1) and second port B(1) and a fourth coupling between third port C(1) and fourth port D(1).

Moreover, an angular position of the second rotor (which may be referred to as the "third angular position"), illustrated in FIG. 6A and FIG. 6B (left hand diagram) provides a fifth coupling between fifth port A(2) and eighth port D(2) and a sixth coupling between sixth port B(2) and seventh port C(2). Another angular position of the second rotor (which may be referred to as the "fourth angular position"), illustrated in FIG. 6B (right hand diagram) and FIG. 6C, provides a seventh coupling between fifth port A(2) and seventh port C(2) and an eighth coupling between sixth port B(2) and eighth port D(2).

It will be observed that, in the embodiment illustrated in FIG. 6A, FIG. 6B and FIG. 6C, first port A(1) and fifth port A(2) are non-selectively coupled. For example, they may be interconnected by a length of unswitched waveguide. Similarly, second port B(1) and sixth port B(2) are non-selectively coupled. As a result, referring now to FIG. 6A, when the first rotor is in the first angular position, thereby coupling first port A(1) with third port C(1), and second port B(1) with fourth port D(1), and the second rotor is in the third angular position, thereby coupling fifth port A(2) with eighth port D(2) and sixth port B(2) with seventh port C(2), third port C(1) is communicatively coupled with eighth port D(2) and seventh port C(2) is communicatively coupled with the fourth port D(1).

Moreover, referring now to FIG. 6B, when the first rotor is in the second angular position and the second rotor is in either the third angular position or the fourth angular position, third port C(1) is communicatively coupled with fourth port D(1) and seventh port C(2) is communicatively coupled with eighth port D(2).

Finally, referring now to FIG. 6C, when the first rotor is in the first angular position and the second rotor is in the fourth angular position, third port C(1) is communicatively coupled with seventh port C(2) and fourth port D(1) is communicatively coupled with eighth port D(2).

In some implementations, a pair of C-switches may be mechanically integrated as a single component, and have a common housing. In such implementations, the C-switches may be coplanar, stacked one above the other or otherwise arranged.

Implementing T-switch functionality with interconnected C-switches as presently disclosed provides particular advantages when applied to a satellite payload including TWTAs arranged in a ring scheme where a significant number of switching elements are required, each of which must have very high reliability.

Thus, an arrangement of rotary waveguide switches providing T-switch functionality has been disclosed. The foregoing merely illustrates principles of the invention. It will be appreciated that those skilled in the art will be able to devise numerous systems and methods which, although not explicitly shown or described herein, embody said principles of the invention and are thus within the spirit and scope of the invention as defined by the following claims.

What is claimed is:

1. An apparatus comprising:

an arrangement of a first four port rotary microwave switch, the first switch including a first rotor and a first set of four waveguide ports, and a second four port rotary microwave switch, communicatively coupled to the first switch, the second switch including a second rotor and a second set of four waveguide ports, wherein each of the first switch and the second switch is a C-switch or an R-switch, and the arrangement provides a switching functionality of a T-switch.

2. The apparatus of claim 1, wherein a first waveguide port of the first set of four waveguide ports is communicatively coupled to a first waveguide port of the second set of four waveguide ports, and a second waveguide port of the first set is communicatively coupled to a second waveguide port of the second set.

3. The apparatus of claim 2, wherein the arrangement is configured to:

switchably interconnect a third waveguide port of the first set of four waveguide ports to a selected one of: (i) a fourth waveguide port of the first set; (ii) a third waveguide port of the second set; and (iii) a fourth waveguide port of the second set.

4. The apparatus of claim 2, wherein the arrangement is configured to:

switchably interconnect a fourth waveguide port of the first set of four waveguide ports to a selected one of: (i) a third waveguide port of the first set; (ii) a third waveguide port of the second set; and (iii) a fourth waveguide port of the second set.

5. The apparatus of claim 2, wherein the arrangement is configured to:

switchably interconnect a third waveguide port of the second set of four waveguide ports to a selected one of: (i) a third waveguide port of the first set; (ii) a fourth waveguide port of the first set; and (iii) a fourth waveguide port of the second set.

6. The apparatus of claim 2, wherein the arrangement is configured to:

switchably interconnect a fourth waveguide port of the second set of four waveguide to a selected one of: (i) a third waveguide port of the first set; (ii) a fourth waveguide port of the first set; and (iii) a third waveguide port of the second set.

7. The apparatus of claim 1, wherein the arrangement includes one or both of a common housing and a common stator for the first switch and the second switch.

8. The apparatus of claim 1, wherein the first switch and the second switch are approximately coplanar.

9. The apparatus of claim 1, wherein the first switch and the second switch are stacked.

10. The apparatus of claim 1, wherein:

the first set of four waveguide ports comprises a first port, a second port, a third port, and a fourth port, a first angular position of the first rotor providing a first coupling between the first port and the second port and a second coupling between the third port and the fourth port; a second angular position of the rotor providing a third coupling between the first port and the third port and a fourth coupling between the second port and the fourth port;

the second set of four ports comprises a fifth port, a sixth port, a seventh port, and an eighth port, a third angular position of the second rotor providing a fifth coupling between the fifth port and the eighth port and a sixth coupling between the sixth port and the seventh port, a fourth angular position of the second rotor providing a seventh coupling between the fifth port and the seventh port, and an eighth coupling between the sixth port and the eighth port;

the first port is communicatively coupled with the fifth port, and the second port is communicatively coupled with the sixth port; and, when the first rotor is in the first angular position, the third port is communicatively coupled with the fourth port and the seventh port is communicatively coupled with the eighth port;

when the first rotor is in the second angular position and the second rotor is in the fourth angular position, the third port is communicatively coupled with the eighth port and the fourth port is communicatively coupled with the seventh port; and when the first rotor is in the second angular position and the second rotor is in the third angular position, the third port is communicatively coupled with the seventh port and the fourth port is communicatively coupled with the eighth port.

11. The apparatus of claim 10, wherein the first port is nonselectively coupled with the fifth port, and the second port is nonselectively coupled with the sixth port.

12. The apparatus of claim 1, wherein the first set of four waveguide ports comprises a first port, a second port, a third port, and a fourth port, a first angular position of the first rotor providing a first coupling between the first port and the third port and a second coupling between the second port and the fourth port; a second angular position of the rotor providing a third coupling between the first port and the second port and a fourth coupling between the third port and the fourth port;

the second set of four ports comprises a fifth port, a sixth port, a seventh port, and an eighth port, a third angular position of the second rotor providing a fifth coupling between the fifth port and the eighth port and a sixth coupling between the sixth port and the seventh port; a fourth angular position of the second rotor providing a seventh coupling between the fifth port and the seventh port, and an eighth coupling between the sixth port and the eighth port;

the first port is communicatively coupled with the fifth port, and the second port is communicatively coupled with the sixth port; and, when the first rotor is in the first angular position and the second rotor is in the third angular position, the third port is communicatively coupled with the eighth port and the fourth port is communicatively coupled with the seventh port;

when the first rotor is in the second angular position, the third port is communicatively coupled with the fourth port and the seventh port is communicatively coupled with the eighth port; and when the first rotor is in the first angular position and the second rotor is in the fourth angular position, the third port is communicatively coupled with the seventh port and the fourth port is communicatively coupled with the eighth port.

13. The apparatus of claim 12, wherein the first port is nonselectively coupled with the fifth port, and the second port is nonselectively coupled with the sixth port.

* * * * *